US009776244B2

(12) United States Patent
Yamashita

(10) Patent No.: US 9,776,244 B2
(45) Date of Patent: Oct. 3, 2017

(54) FORMING DIE ASSEMBLY

(71) Applicant: TOYOTA JIDOSHA KABUSHIKI KAISHA, Toyota-shi, Aichi-ken (JP)

(72) Inventor: Osamu Yamashita, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 15 days.

(21) Appl. No.: 14/835,122

(22) Filed: Aug. 25, 2015

(65) Prior Publication Data

US 2016/0059294 A1 Mar. 3, 2016

(30) Foreign Application Priority Data

Aug. 28, 2014 (JP) ..... 2014-173636
Apr. 6, 2015 (JP) ..... 2015-077721

(51) Int. Cl.

| | |
|---|---|
| ***B22F 3/14*** | (2006.01) |
| ***B30B 11/00*** | (2006.01) |
| ***B21D 22/02*** | (2006.01) |
| ***B22F 3/00*** | (2006.01) |
| ***B30B 11/02*** | (2006.01) |

(52) U.S. Cl.

CPC ..... *B22F 3/14* (2013.01); *B22F 3/003* (2013.01); *B30B 11/007* (2013.01); *B30B 11/02* (2013.01); *B22F 2999/00* (2013.01); *C22C 2202/02* (2013.01)

(58) Field of Classification Search

CPC ..... B30B 11/10; B30B 11/02; B30B 11/007; B21D 22/02; B21D 22/10; B21J 5/08; B21J 5/0255; B21J 5/025; B21J 9/02; B21J 9/06; B21J 13/02; B21J 13/025; B21J 13/03; B21C 23/21; B21C 23/212; B21C 23/218; B21C 23/18; B21C 23/83; B21C 23/86; B21C 23/20; B22F 3/14; B22F 3/003

See application file for complete search history.

(56) References Cited

U.S. PATENT DOCUMENTS

| | | | | |
|---|---|---|---|---|
| 1,966,723 A * | 7/1934 | Ireland | B21D 22/02 29/890.03 |
| 3,670,556 A * | 6/1972 | Kralowetz | B21J 13/02 72/402 |
| 2011/0036967 A1 | 2/2011 | Long et al. | |
| 2013/0205863 A1* | 8/2013 | Loesch | B21D 22/06 72/342.7 |

FOREIGN PATENT DOCUMENTS

| | | |
|---|---|---|
| CA | 2887984 A1 | 5/2014 |
| JP | 2011-036913 A | 2/2011 |
| JP | 2012-138507 A | 7/2012 |
| JP | 2014-103386 A | 6/2014 |

* cited by examiner

*Primary Examiner* — Teresa M Ekiert
(74) *Attorney, Agent, or Firm* — Sughrue Mion, PLLC

(57) ABSTRACT

A forming die assembly includes an upper die including a first backup member and a first press member that is attached to the first backup member, has an L shape in a vertical sectional view, and is heat-resistant; and a lower die including a second backup member and a second press member that is attached to the second backup member, has an L shape in the vertical sectional view, and is heat-resistant. The first press member and the second press member press upper and lower surfaces of a workpiece accommodated in a press space that is formed between the first press member and the second press member, so as to produce a forged product.

7 Claims, 10 Drawing Sheets

FORMING DIE ASSEMBLY

INCORPORATION BY REFERENCE

The disclosure of Japanese Patent Application No. 2015-077721 filed on Apr. 6, 2015 including the specification, drawings and abstract is incorporated herein by reference in its entirety.

BACKGROUND OF THE INVENTION

1. Field of the Invention

The invention relates to a forming die assembly for manufacturing a forged product.

2. Description of Related Art

A rare-earth magnet including a rare-earth element such as lanthanoid is also referred to as a permanent magnet. The rare-earth magnet is used in a driving motor and the like for a hybrid vehicle, an electric vehicle, and the like, in addition to a motor of a hard disc or a magnetic resonance imaging (MRI) device.

Examples of indices indicating magnetic performance of this rare-earth magnet include residual magnetization (residual magnetic flux density) and coercivity. Meanwhile, due to an increase in a calorific value caused by downsizing of a motor and high current density, demands for heat resistance of the rare-earth magnet in use have further been increased. Accordingly, retention of a magnetic property of the magnet used at high temperature is one of the major research themes in the technical field.

One example of a method for manufacturing the rare-earth magnet will briefly be described. Fine powder obtained from rapid solidification of Nd—Fe—B-based molten metal, for example, is subjected to hot pressing, and a sintered body is thereby produced. Then, in order to impart magnetic anisotropy to this sintered body, hot working is performed thereon. The rare-earth magnet (an oriented magnet) is manufactured in this way, and this method is generally used.

This hot working is a kind of hot forging, and the hot forging process includes extrusion, such as forward extrusion and backward extrusion, in addition to upsetting.

In particular, upsetting is generally used, in which a sintered body is disposed in a forming die assembly including at least an upper die and a lower die, the body is heated and pressed, for example, for approximately one second or less by the upper die, and the body is further pressed until a specified working ratio is obtained. A method for manufacturing a rare-earth magnet by imparting magnetic anisotropy to a sintered body through upsetting is disclosed in Japanese Patent Application Publication No. 2014-103386 (JP 2014-103386 A) and Japanese Patent Application Publication No. 2012-138507 (JP 2012-138507 A).

As for a conventional forming die assembly used for upsetting, the upper die and the lower die are integrally formed of steel or Inconel (registered trademark). Accordingly, when either the upper die or the lower die is damaged after repetitive use, the entire upper die and the entire lower die need to be replaced.

In addition, as for a forming die assembly used for closed-die forging, in which a workpiece is forged in the tightly closed forming die assembly, among upsetting, the upper die or the lower die is subjected to drilling and thereby provided with a recess for accommodating the workpiece. Accordingly, it is time-consuming to produce the forming die assembly, and as a result, production cost is increased.

SUMMARY OF THE INVENTION

The invention relates to a forming die assembly used in upsetting, and the invention provides a forming die assembly which is easily produced, and which makes it possible to replace only a portion that tends to be damaged from repetitive use.

A forming die assembly according to an aspect of the invention includes an upper die including a first backup member and a first press member that is attached to the first backup member, has an L shape in a vertical sectional view, and is heat-resistant; and a lower die including a second backup member and a second press member that is attached to the second backup member, has an L shape in the vertical sectional view, and is heat-resistant. The first press member and the second press member press upper and lower surfaces of a workpiece accommodated in a press space that is formed between the first press member and the second press member, so as to produce a forged product.

In the forming die assembly according to the above-described aspect of the invention, each of the upper die and the lower die includes the press member, which directly contacts the forged workpiece, and the backup member, to which the press member is detachably attached. The press member and the backup member are produced as separate components and fitted to each other. Accordingly, the press member that tends to be damaged from repetitive use can be detached from the backup member for replacement. Thus, as compared to a conventional forming die assembly, in which the entire upper die or the entire lower die is replaced, replacement cost can be substantially lowered.

In addition, the press members of both of the upper die and the lower die have the L shapes in the vertical sectional view. For example, the upper die and the lower die are configured such that the press member of the lower die is disposed in the L shape and the press member of the upper die is disposed in an inverted L shape that is the shape obtained by inverting the L shape. Thus, the workpiece can be pressed by one surface of each of the press members, which constitutes the L shape, and a shape of the workpiece that is pressed and expanded laterally can be defined by the other surface of each of the press members.

Furthermore, the press member, which has the L shape in the vertical sectional view, is configured to be attached to the backup member. Thus, time-consuming work in which the upper die or the lower die is subjected to drilling to form a recess is unnecessary.

Moreover, the press member is heat-resistant and can be produced from Inconel or ceramic, for example. The press member may be produced from ceramic with high heat resistance. Meanwhile, since the backup member is not required to have heat resistance, the backup member can be produced from an ordinary steel material.

As described above, an opening is provided at a side of the press space, which is formed between the L-shaped first and second press members, that is, at a side where neither of the L-shaped press members is present. Thus, it can be said that the forming die assembly with the above-described configuration is a forming die assembly for semi-closed upsetting.

Each of the first press member and the second press member may be formed by two plate members.

The press member having the L shape in the vertical sectional view is formed by bonding the two plate members (causing the two plate members to adhere to each other) or fastening the two plate members by a bolt or the like. Accordingly, as compared to a case where the L-shaped press member is produced at one time, production of the press member is facilitated, and dies whose cavity shape is complicated for producing a press member are unnecessary.

In addition, when a lateral surface of each of the two plate members that contacts the workpiece is damaged due to the repetitive use, the first and second press members are reproduced by replacing the lateral surface that contacts the workpiece with an undamaged lateral surface of each of the plate members, and can be respectively attached to the first and second backup members. According to this maintenance method, material cost including maintenance can be significantly lowered.

One of the upper die and the lower die may be provided with a recess and the other of the upper die and the lower die may be provided with a projection; and the projection may be fitted to the recess when the forming die assembly is in a closed state in which the upper die and the lower die are fitted to each other.

Due to upsetting, an external force (thrust), which causes the workpiece to expand laterally and to contact portions of the press members and is directed in an expansion direction of the workpiece, acts on the press members of both of the upper die and the lower die.

For example, the projection of the upper die is fitted to the recess of the lower die when the upper die and the lower die are fitted to each other to press the workpiece. Thus, it is possible to resist the thrust that acts on the press members.

The recess may be formed in the corresponding backup member of the one of the upper die and the lower die; and the projection may be formed by a portion of the corresponding press member of the other of the upper die and the lower die, and a portion of the corresponding backup member of the other of the upper die and the lower die.

The forming die assembly according to the above-described aspect may further include a closing member that closes a lateral opening of the press space formed between the first press member and the second press member.

For example, the closing member in a rectangular ring shape or in a shape obtained by removing one lateral surface from the rectangular ring shape (i.e., a U shape) is fitted to the upper die or the lower die. Thus, the lateral opening of the press space can be closed.

It can be said that the forming die assembly with the above-described configuration is a forming die assembly for closed upsetting in which the press space is completely closed. Accordingly, when the workpiece is pressed to produce the forged product, four lateral surfaces and two upper and lower surfaces of the forged product are restrained by the two press members, each of which has the L shape in the vertical sectional view, and closing member, and thus a forged product in a hexahedral shape, such as a cube or a rectangular cuboid, can be produced. Thus, unlike a case of free upsetting with no restraint of the lateral surfaces or the semi-closed upsetting with partial restraint of the lateral surfaces, it is not necessary to perform post-processing that includes trimming of an expanded portion of the produced forged product, which is expanded due to a lack of restraint.

The closing member may include a third backup member and a heat-resistant plate member that contacts the pressed workpiece.

In addition, the heat-resistant plate member that forms the closing member may be formed of ceramic, together with the first and second press members. For example, each of the first, second, and third backup members is formed of an ordinary steel material, and each of the first and second press members and the plate member forming the closing member is formed of ceramic. Thus, portions of the forming die assembly that directly contact the workpiece have high heat resistance, and production cost of the forming die assembly can be lowered as much as possible.

The closing member may include a link mechanism including a toggle clamp, the link mechanism may allow the closing member to be movable between a closed position at which the opening is closed and an open position at which the opening is opened, and the link mechanism may be fixed by the toggle clamp when the link mechanism is at the closed position.

The workpiece that is subjected to upsetting in the forming die assembly with each of the various configurations described above is not particularly limited. A sintered body as a precursor of the above-described rare-earth magnet can be exemplified, and the forming die assembly can be applied to hot working.

As it can be understood from the above description, in the forming die assembly according to the above-described aspect of the invention, each of the upper die and the lower die includes the press member, which directly contacts the forged workpiece, and the backup member, to which the press member is detachably attached. The press member and the backup member are produced as separate components and fitted to each other. Accordingly, the press member that tends to be damaged from repetitive use can be detached from the backup member for replacement. Thus, as compared to the conventional forming die assembly, in which the entire upper die or the entire lower die is replaced, the replacement cost can be substantially lowered. In addition, the press member, which has the L shape in the vertical sectional view, is configured to be attached to the backup member. Thus, time-consuming work in which the upper die or the lower die is subjected to drilling to form the recess is unnecessary. Furthermore, the workpiece can be pressed by the one surface of each of the press members, which constitutes the L shape, and the shape of the workpiece that is pressed and expanded laterally can be defined by the other surface of each of the press members.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A description will hereinafter be made on a forming die assembly according to embodiments of the invention with reference to the drawings. In an illustrated example, a sintered body as a precursor of a rare-earth magnet is shown as a workpiece that is subjected to upsetting. However, it is needless to say that the workpiece subjected to upsetting in the forming die assembly of the invention is not limited to the sintered body.

Figure 1:
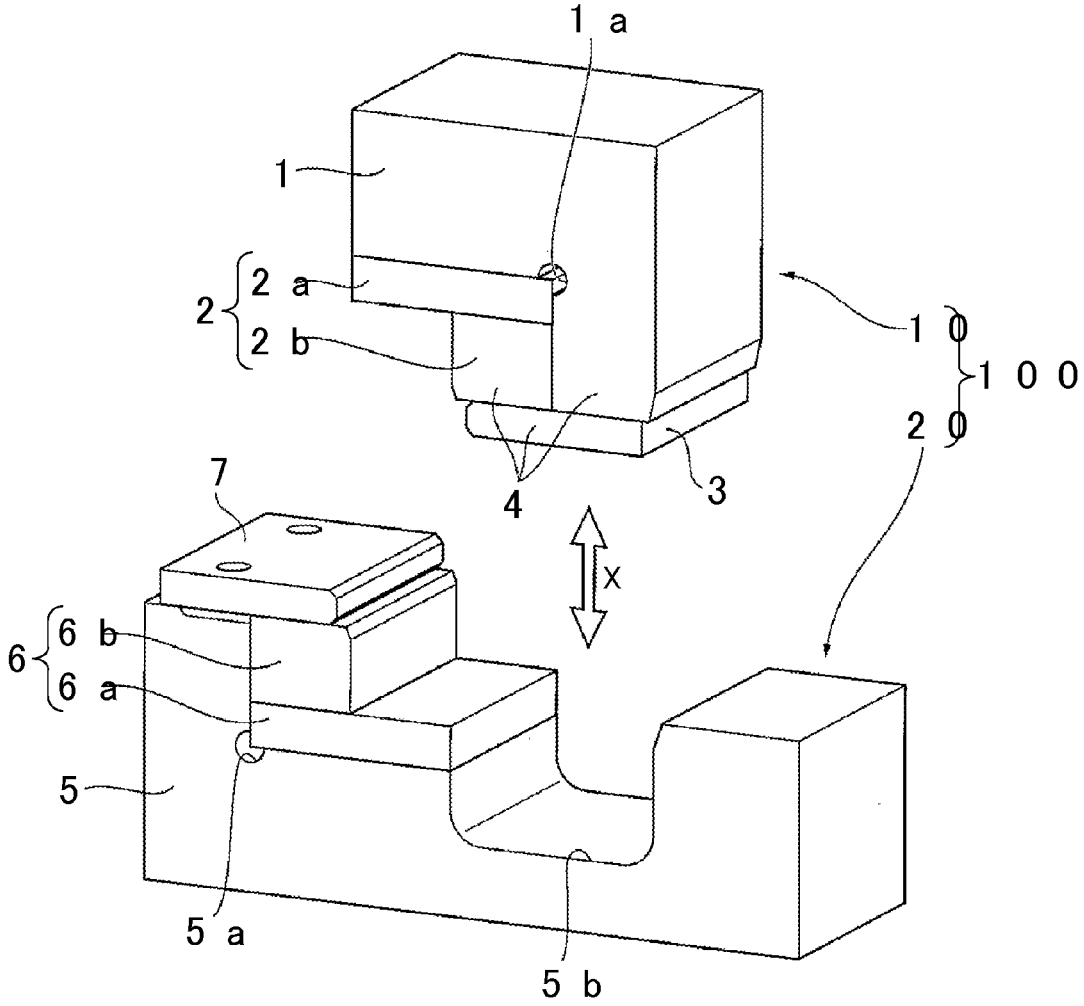
FIG. 1 is a perspective view showing a state where a forming die assembly according to a first embodiment of the invention is opened.
Figure 2:
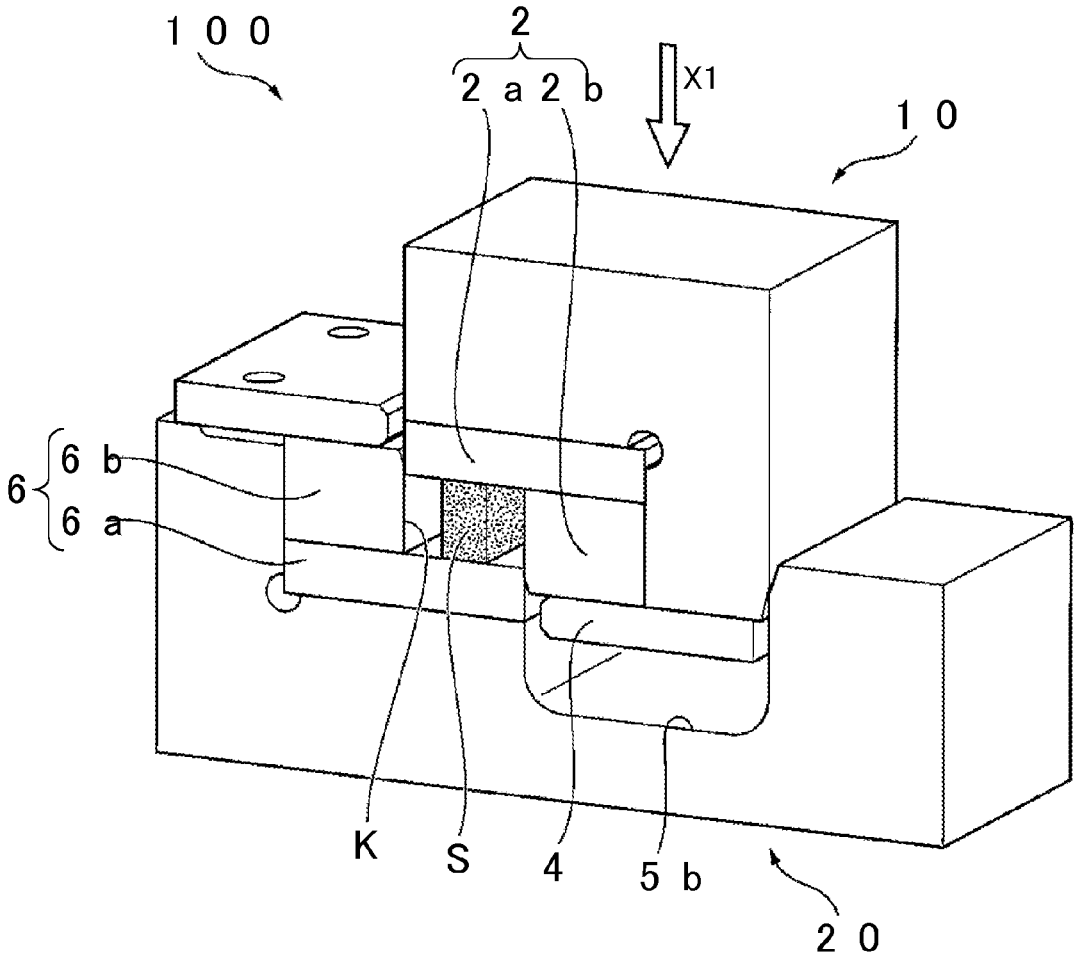
FIG. 2 is a view showing a state where a sintered body is subjected to upsetting in the forming die assembly according to the first embodiment.
Figure 3:
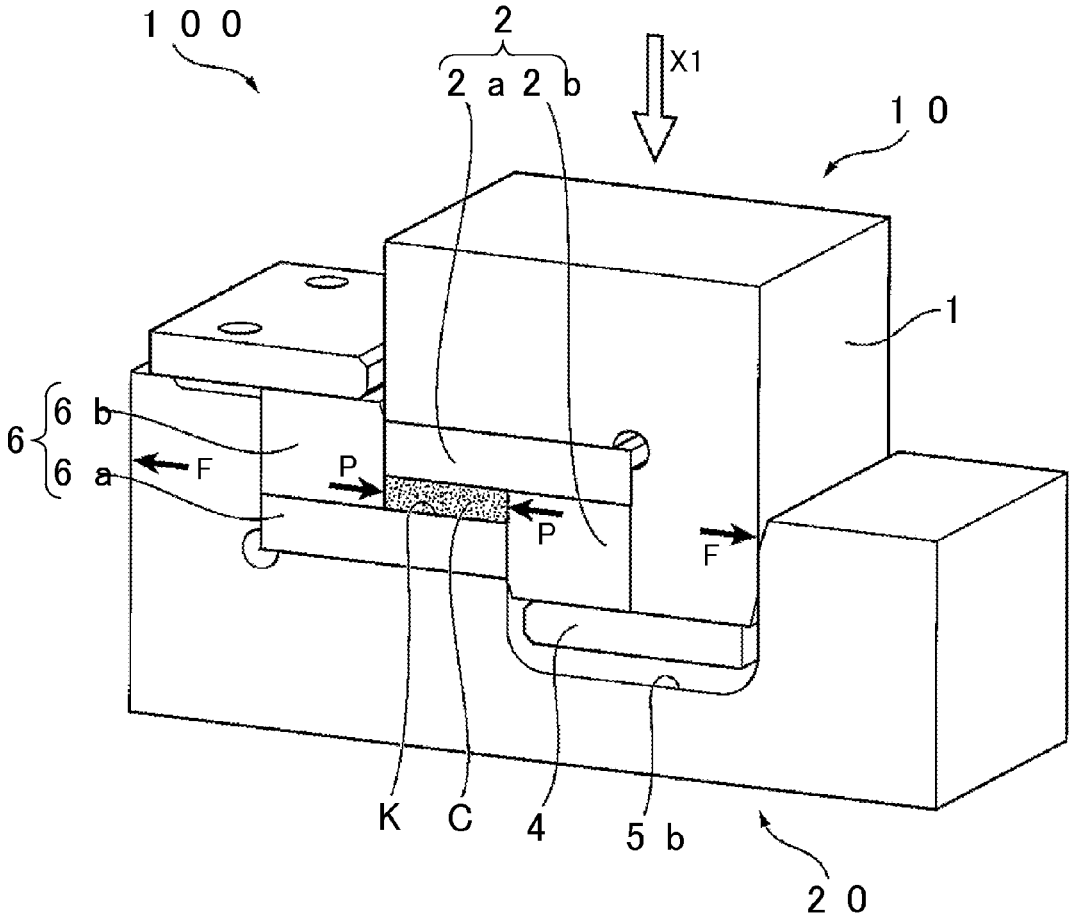
FIG. 3 is a view showing a state where upsetting is completed.

(Forming Die Assembly according to First Embodiment) FIG. 1 is a perspective view showing a state in which a forming die assembly according to a first embodiment of the invention is opened. FIG. 2 is a view showing a state in which a sintered body is subjected to upsetting in the forming die assembly according to the first embodiment. FIG. 3 is a view showing a state in which upsetting is completed.

A forming die assembly 100, which is shown, includes an upper die 10 and a lower die 20, and the upper die 10 is configured to be lifted and lowered (in an X direction) by a lifting mechanism, which is not shown.

The upper die 10 includes a first backup member 1 and a first press member 2 that is attached to a groove provided on the inside of the first backup member 1.

The first press member 2 is configured to have an L shape in a vertical sectional view, in which two plate members 2*a*, 2*b* are adhered to each other, and the first press member 2 is adhered to the groove of the first backup member 1. Furthermore, the first press member 2 and the first backup member 1 are firmly fixed by a holding member 3.

Here, the first backup member 1 and the holding member 3 are produced from an ordinary steel material. Meanwhile, the two plate members 2*a*, 2*b* that form the first press member 2 are members that directly perform hot pressing on a sintered body S as a workpiece and directly hold the pressed and expanded sintered body S. Thus, the two plate members 2*a*, 2*b* are required to have heat resistance. Accordingly, the plate members 2*a*, 2*b* are produced from Inconel (registered trademark), ceramic, or the like, and in particular, the plate members 2*a*, 2*b* are preferably produced from ceramic with high heat resistance.

Meanwhile, the lower die 20 includes a second backup member 5 and a second press member 6 that is attached to a groove provided on the inside of the second backup member 5.

The second press member 6 is configured to have an L shape in the vertical sectional view, in which two plate members 6*a*, 6*b* are adhered to each other, and the second press member 6 is adhered to the groove of the second backup member 5. Furthermore, the second press member 6 and the second backup member 5 are firmly fixed by a holding member 7.

The upper die 10 is lowered with respect to the lower die 20, and both of the press members 2, 6 press the sintered body S that is disposed in a press space K, the press space K being formed between both of the press members 2, 6. Accordingly, a projection 4 formed in the upper die 10 is fitted to a recess 5*b* formed in the lower die 20. More specifically, the projection 4 is formed by a portion of the first backup member 1, the plate member 2*b* as one of the members of the first press member 2, and the holding member 3. The recess 5*b* is formed in the second backup member 5.

Ceramic, which is a production material used to produce the first and second press members 2, 6, is difficult to machine and more expensive than the ordinary steel material. However, since the first and second press members 2, 6 are respectively formed by the plate members 2*a* and 2*b*, 6*a* and 6*b* in simple shapes as shown in the illustrated example, the plate members 2*a*, 2*b*, 6*a*, 6*b* can be machined extremely easily. In addition, not all portions of the upper die 10 and lower die 20 are produced from ceramic, and only the first and second press members 2, 6, which are required to have heat resistance, are produced from ceramic. Thus, an increase in production cost can be suppressed.

While damage due to repetitive use is less likely to occur in the first and second backup members 1, 5, which do not directly contact the sintered body S, the first and second press members 2, 6, which directly contact the sintered body S, are more likely to be damaged. In the upper die 10, the first press member 2 is attached to the first backup member 1, and in the lower die 20, the second press member 6 is attached to the second backup member 5. Accordingly, when the first and second press members 2, 6 are damaged due to the repetitive use, the first and second press members 2, 6 are removed from the first and second backup members 1, 5, and the first and second press members 2, 6 can be replaced with the new first and second press members 2, 6.

In addition, when a lateral surface of each of the plate members 2*a*, 2*b*, 6*a*, 6*b* that contacts the sintered body S is damaged due to the repetitive use, instead of the replacement with the new plate members, the first and second press members 2, 6 can be reproduced by replacing the lateral surface of each of the plate members 2*a*, 2*b*, 6*a*, 6*b* that contacts the sintered body S with a lateral surface thereof that is not damaged and can be respectively attached to the first and second backup members 1, 5. With this maintenance method, it is possible to significantly lower material cost including maintenance.

Here, each corner of the grooves of the first and second backup members 1, 5 has a slight curved shape for the convenience of machining. Accordingly, clearance holes la, 5*a* are provided at the corners of these grooves, and thus interference of the plate members 2*a*, 6*a* with the corners of the grooves can be prevented. In addition, since the clearance holes la, 5*a* are provided at the corners of the grooves, the first and second press members 2, 6 can easily be removed during the above maintenance for replacing the press lateral surfaces of the first and second press members 2, 6.

When the forming die assembly 100 shown in FIG. 1 is used for upsetting of the sintered body S, the sintered body S is disposed in the press space K that is formed between the first and second press members 2, 6 as shown in FIG. 2.

As it is apparent from the drawing, since openings are formed at sides of the press space K, which is formed between the L-shaped first and second press members 2, 6, that is, at sides where neither of the L-shaped press members 2, 6 is present, the forming die assembly 100, which is shown, is a forming die assembly for semi-closed upsetting.

Upper and lower surfaces of the sintered body S respectively contact the plate members 2*a*, 6*a*, and are respectively pressed by the first and second press members 2, 6.

With respect to the heated lower die 20, the upper die 10, which is also heated in a similar manner, is further lowered (in an X1 direction), and upsetting is thereby performed.

It should be noted that this upsetting is hot working for imparting the magnetic anisotropy to the sintered body S, and the sintered body S is pressed by the heated upper die 10 for a short time, for example, approximately one second or less.

By this upsetting, the sintered body S is squashed in the press space K, and a rare-earth magnet C as a forged product is produced as shown in FIG. 3.

In a stage where the rare-earth magnet C is produced, the rare-earth magnet C applies thrust F directed toward the laterally outside, to the plate members 2*b*, 6*b* of the first and second press members 2, 6.

Thus, a flat lateral surface shape of the rare-earth magnet C is defined by reaction force P to this thrust F.

The lateral thrust F is applied to the upper die 10 and the lower die 20 by the rare-earth magnet C. However, since the projection 4 of the upper die 10 is fitted to the recess 5*b* of the lower die 20, the upper die 10 and the lower die 20 can resist this thrust F.

Since the forming die assembly 100 is the forming die assembly for semi-closed upsetting, in fact, lateral surfaces of the rare-earth magnet C that are not restrained by the first and second press members 2, 6 may be expanded laterally and may have curved shapes. Accordingly, in order to change the lateral surfaces, which are expanded laterally and have the curved shapes as described above, to flat surfaces, the lateral surfaces are trimmed. In this manner, the rare-earth magnet in a cube or a rectangular cuboid shape, for example, is produced.

Here, a method for producing the sintered body S will briefly be described. For example, in an unillustrated furnace, alloy ingots are subjected to high-frequency melting under reduced pressure of 50 kPa or lower in an Ar gas atmosphere using a single-roll melt-spinning method, and molten metal with a composition of the rare-earth magnet is sprayed to an unillustrated copper roll to produce a rapidly cooled thin belt (a rapidly cooled ribbon, rapidly quenched ribbon). Then, the rapidly cooled thin belt is roughly crushed.

The rapidly cooled thin belt, which is roughly crushed, is filled in a cavity defined by an unillustrated carbide die and an unillustrated carbide punch that slides in a hollow space therein, and is subjected to electric heating by being supplied with a current flowing in a pressurizing direction while being pressurized by the carbide punch. In this manner, the sintered body S is manufactured. The sintered body S has a structure that is formed of a main phase and a grain boundary phase, and has a composition of $(Rl)_x(Rh)_yT_zB_sM_t$ (Rl represents at least one light rare-earth element including Y, Rh represents at least one heavy rare-earth element including at least one of Dy and Tb, T represents at least one transition metal including at least one of Fe, Ni, and Co, B represents boron, and M represents at least one of Ti, Ga, Zn, Si, Al, Nb, Zr, Ni, Co, Mn, V, W, Ta, Ge, Cu, Cr, Hf, Mo, P, C, Mg, Hg, Ag, and Au). The main phase has a crystal grain size of approximately 50 nm to 300 nm. The grain boundary phase of the sintered body S contains Nd and the like as well as at least one of Ga, Al, Cu, Co, and the like, and is in a Nd-rich state. In addition, the grain boundary phase is mainly formed of an Nd phase and an $Nd_{1.1}T_4B_4$ phase, for example.

Figure 4A:
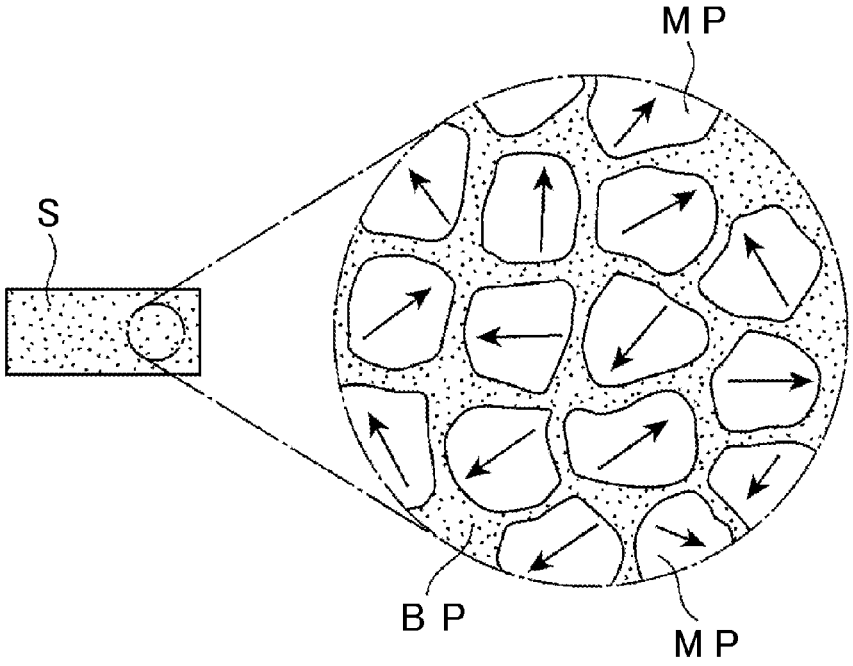
FIG. 4A is a view illustrating a microstructure of the sintered body.
Figure 4B:
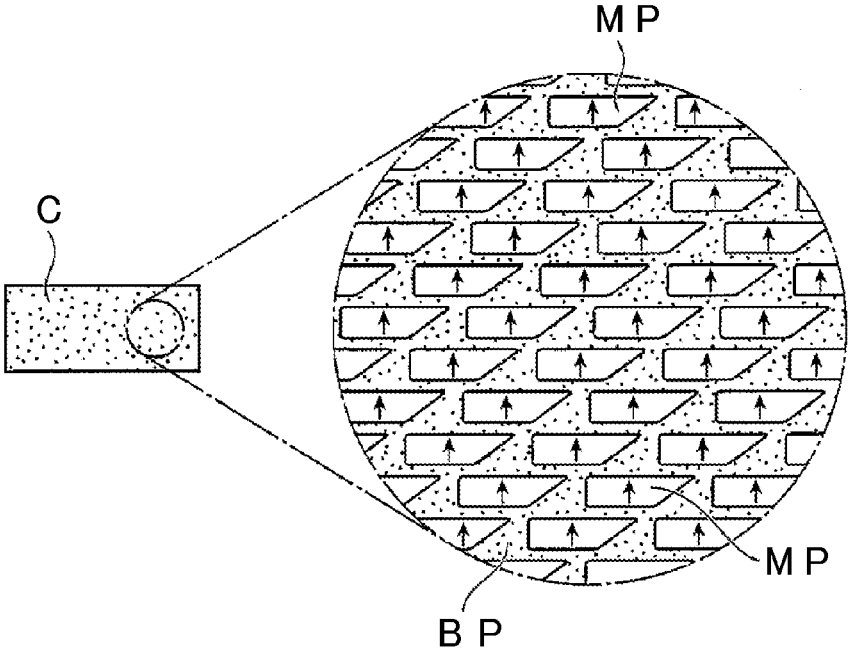
FIG. 4B is a view illustrating a microstructure of a rare-earth magnet that is produced when the sintered body is subjected to upsetting.

Here, FIG. 4A is a view for illustrating a microstructure of the sintered body S, and FIG. 4B is a view for illustrating a microstructure of the rare-earth magnet C that is produced when the sintered body S is subjected to upsetting.

As shown in FIG. 4A, the sintered body S has an isotropic crystal structure in which a grain boundary phase BP is filled between nanocrystal grains MPs (main phases). As shown in FIGS. 1 to 3, upsetting is performed on this sintered body S by using the forming die assembly 100, so as to impart the magnetic anisotropy thereto. Accordingly, as shown in FIG. 4B, the rare-earth magnet C with the crystal structure that has the anisotropic nanocrystal grains MPs is produced.

It should be noted that, a case where a working ratio (a machining ratio, a compression ratio) achieved by hot working is high, for example, a case where the compression ratio is approximately 10% or higher may be referred to as hard hot working or simply as hard working. It is preferred to perform hard working at the compression ratio of approximately 60 to 80%.

Figure 5:
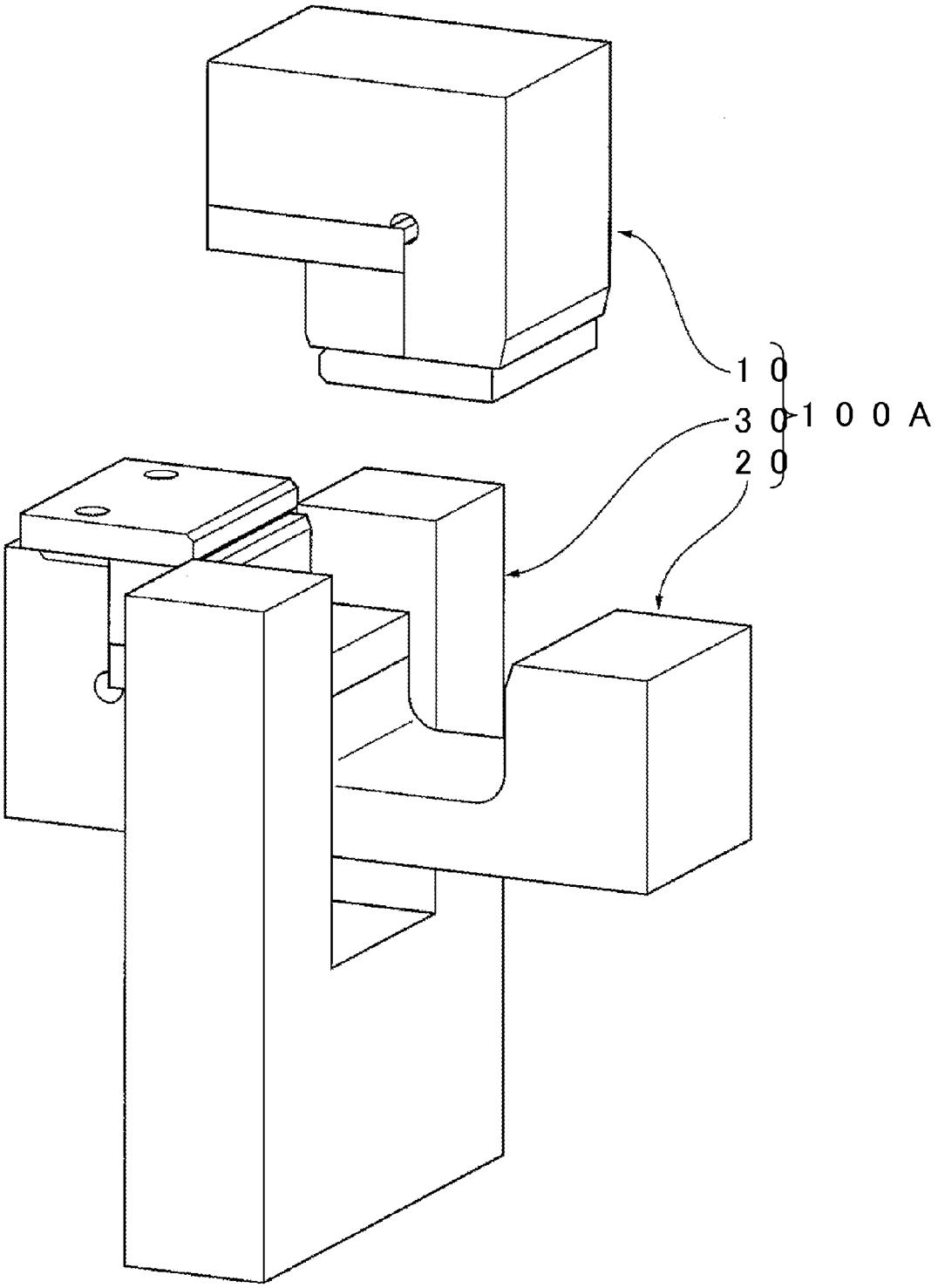
FIG. 5 is a perspective view showing a state where a forming die assembly according to a second embodiment of the invention is opened.
Figure 6:
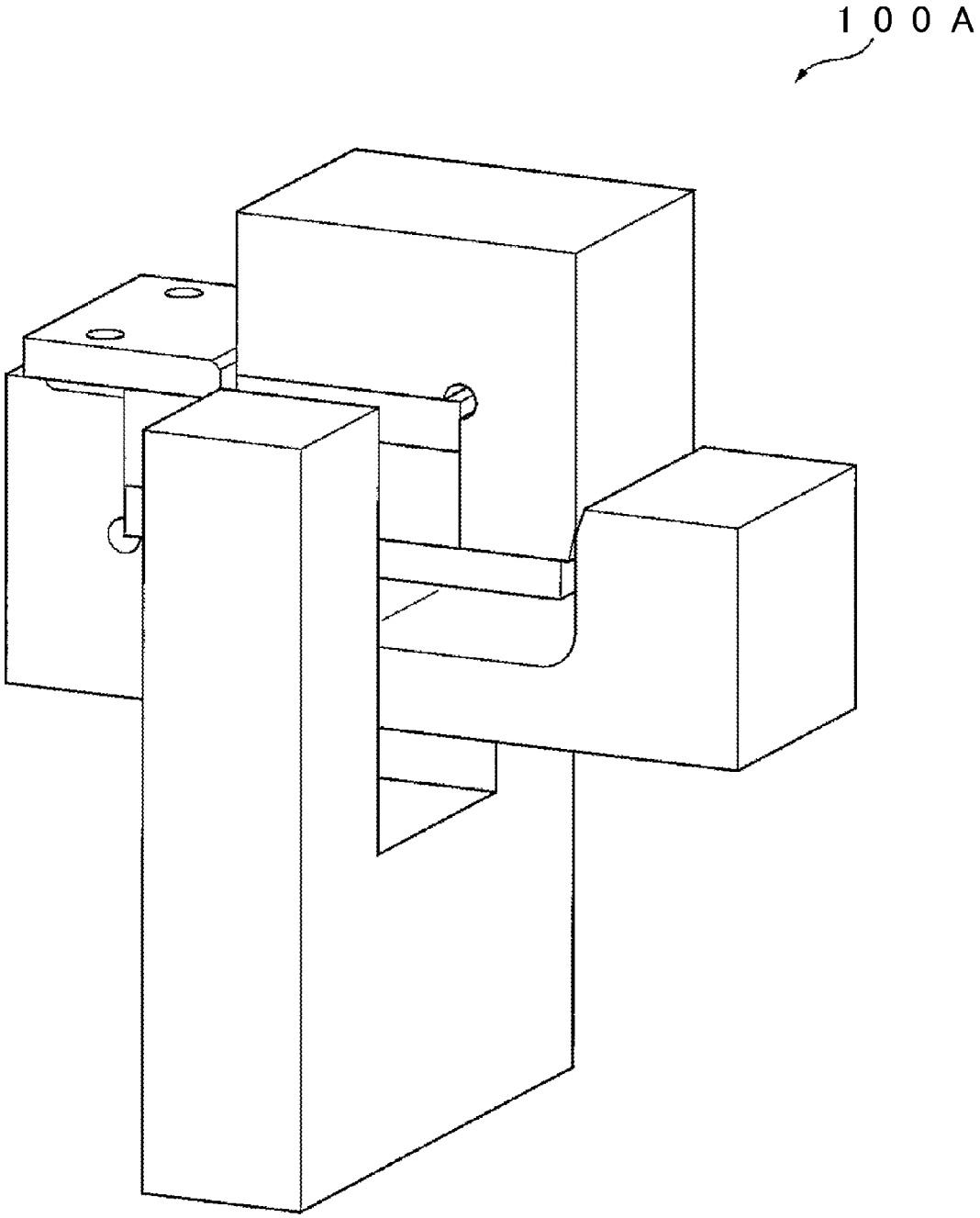
FIG. 6 is a view showing a state where the sintered body is subjected to upsetting in the forming die assembly according to the second embodiment.

(Forming Die Assembly according to Second Embodiment) FIG. 5 is a perspective view showing a state where a forming die assembly according to a second embodiment of the invention is opened, and FIG. 6 is a view showing a state where the sintered body is subjected to upsetting in the forming die assembly according to the second embodiment.

As compared to the forming die assembly 100 shown in FIG. 1, in a forming die assembly 100A, which is shown, a closing member 30 in a shape obtained by removing one lateral surface from a rectangular ring shape (i.e., a U shape) is fitted to the lower die 20, so as to close openings at sides of a press space.

As it is apparent from FIGS. 5, 6, the forming die assembly 100A is a forming die assembly for closed upsetting in which the press space is completely closed. Thus, when the sintered body is subjected to upsetting and the rare-earth magnet is produced, the produced rare-earth magnet has a hexahedral shape, such as a cube or a rectangular cuboid. Therefore, it is not necessary to perform post-processing that includes trimming of an expanded portion of the produced rare-earth magnet, which is expanded due to a lack of restraint. That is, it is not necessary to perform the post-processing required in the case of free upsetting with no restraint of the lateral surfaces and semi-closed upsetting with partial restraint of the lateral surfaces.

Figure 7:
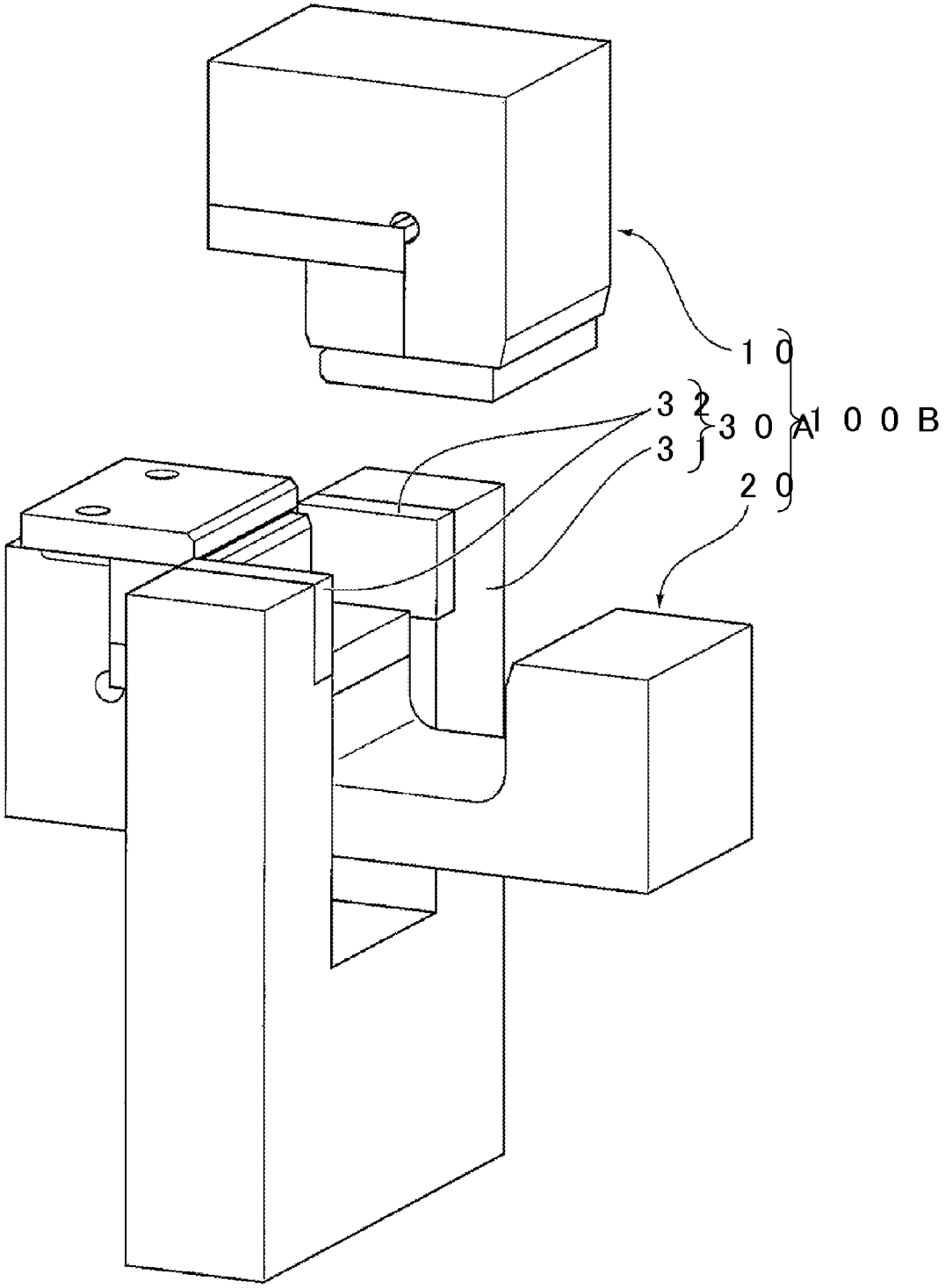
FIG. 7 is a perspective view showing a state where a forming die assembly according to a third embodiment of the invention is opened.

(Forming Die Assembly according to Third Embodiment) FIG. 7 is a perspective view showing a state where a forming die assembly according to a third embodiment of the invention is opened.

In a forming die assembly 100B, which is shown, a closing member 30A includes a third backup member 31 and heat-resistant plate members 32 that contact the pressed sintered body.

For example, in addition to the first and second press members 2, 6, the heat-resistant plate members 32, which form the closing member 30A, may be formed of ceramic.

In the forming die assembly 100B, all of the lateral surfaces, which may contact the sintered body S, are formed of the heat-resistant plate members. Thus, the forming die assembly 100B is a forming die assembly with excellent durability. In other words, in the case where the sintered body that is disposed in the press space is, for example, a hexahedron, each of the four lateral surfaces may be disposed to face any one of the plate members. In such a case, when the sintered body is squashed by upsetting and the lateral surfaces of the sintered body are expanded, it is possible to suppress degradation of the durability of the plate members due to contact with the sintered body, because each of the plate members has heat resistance.

Figure 8:
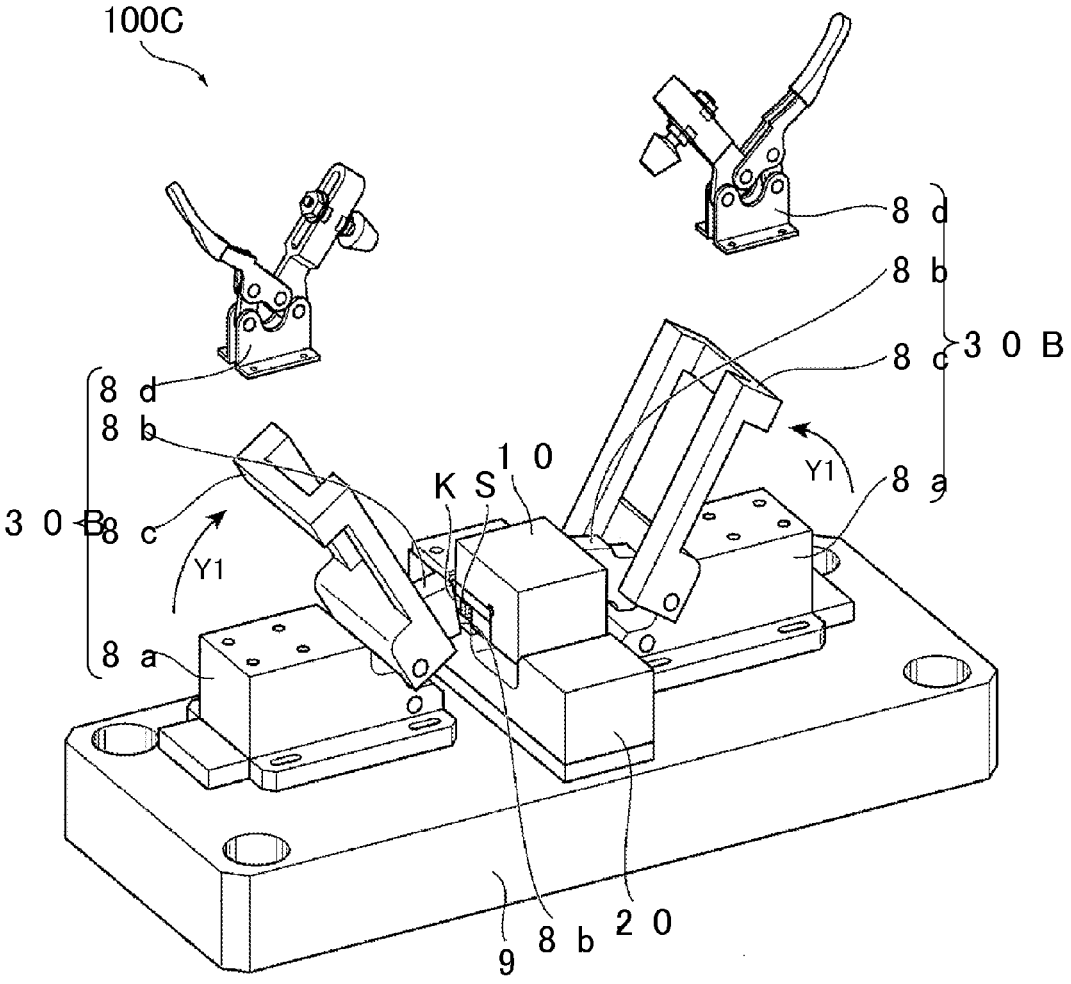
FIG. 8 is a perspective view of a forming die assembly according to a fourth embodiment of the invention, the perspective view showing a state where a closing member is at an open position and preparation for upsetting is completed.
Figure 9:
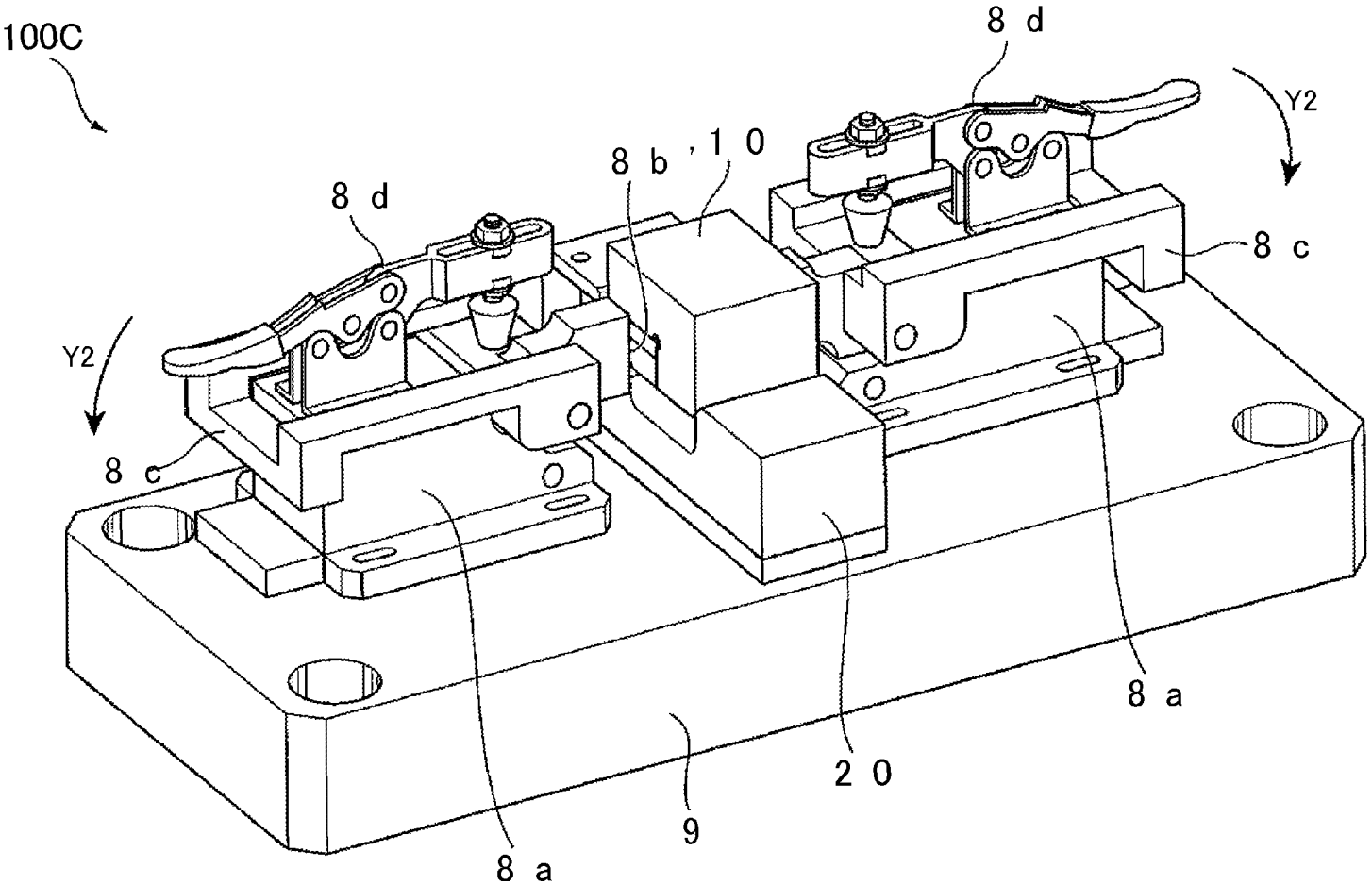
FIG. 9 is a view showing a state where the closing member is at a closed position and upsetting is performed.
Figure 10:
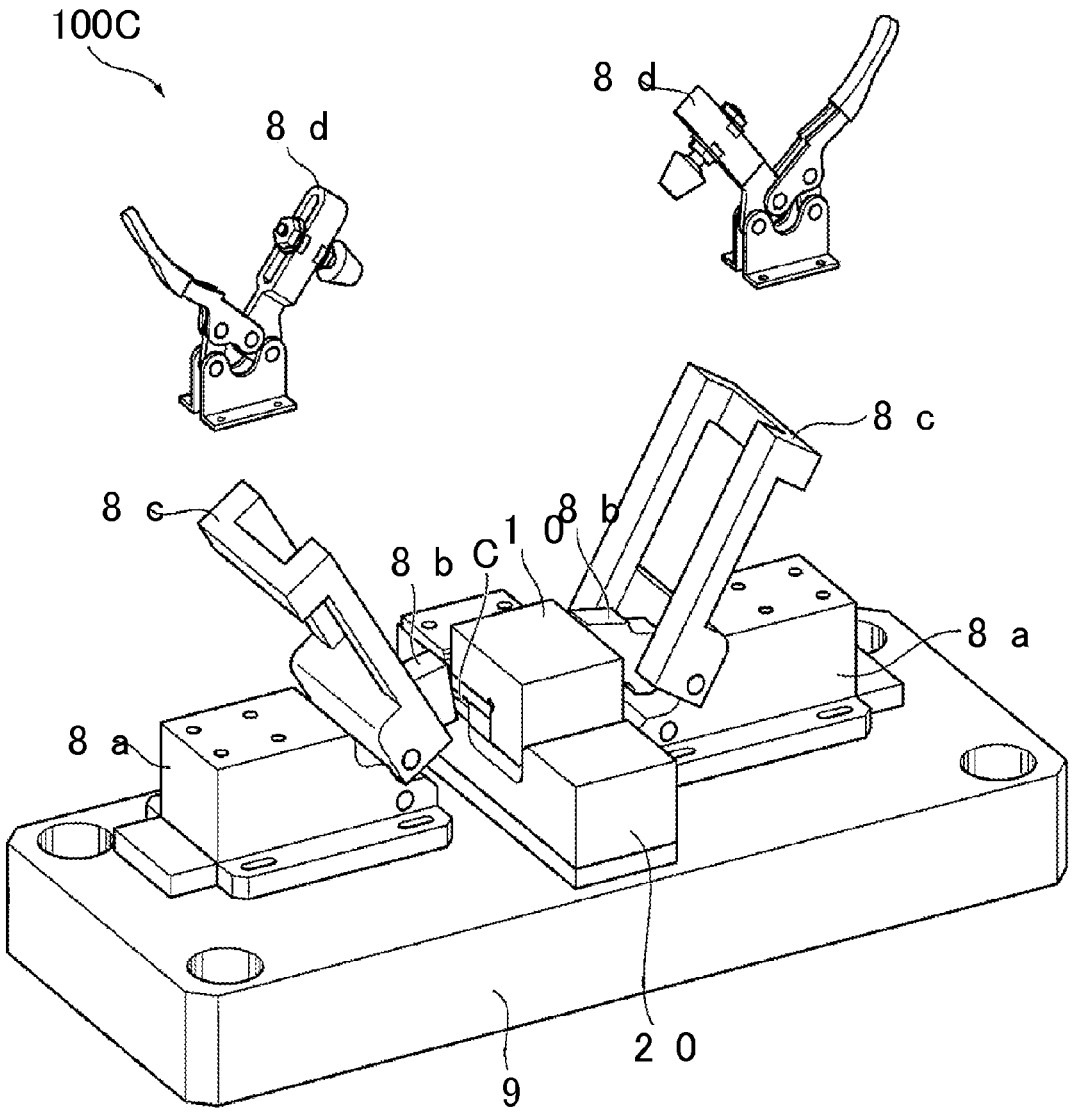
FIG. 10 is a view showing a state where the closing member is at the open position and upsetting is completed.

(Forming Die Assembly according to Fourth Embodiment) FIG. 8 is a perspective view of a forming die assembly according to a fourth embodiment of the invention, the perspective view showing a state where a closing member is in an open position and preparation for upsetting is completed. FIG. 9 is a view showing a state where the closing member is in a closed position and upsetting is performed. FIG. 10 is a view showing a state where the closing member is in the open position and upsetting is completed.

In an entire forming die assembly 100C, which is shown, the upper die 10 and the lower die 20 are placed on a base member 9 and two closing members 30B are placed on sides of the upper die 10 and the lower die 20.

Each of the entire closing members 30B is configured such that a first link member 8*b* is rotatably fitted to a block-shaped seat 8*a*, a ring-shaped second link member 8*c* is rotatably fitted to the first link member 8*b*, and a toggle clamp 8*d* is placed on an upper surface of the seat 8*a*. Here, when the second link member 8*c* is lowered (see FIG. 9), an upper portion of the seat 8*a* is fitted in a hollow space of the second link member 8*c*.

As shown in FIG. 8, the second link member 8*c* is lifted (in a Y1 direction), and an end surface 8*b*' of the first link member 8*b* that faces the press space K is inclined upward. The end surface 8*b*' is a member that directly closes the lateral opening of the press space K, and a posture thereof shown in FIG. 8 indicates an open position of the end surface 8*b*' (an open position of the closing member 30B). When the sintered body S is accommodated in the press space K and each of the closing members 30B is set in the open position shown in FIG. 8, the preparation for upsetting is completed. It should be noted that, although each of the toggle clamps 8*d* is shown to separate from the corresponding seat 8*a* in FIG. 8 for the sake of illustration convenience, the toggle clamp 8*d* is actually fixed to the seat 8*a*. A lever of the toggle clamp 8*d* is lifted in an unclamping state and thus does not interfere with the second link member 8*c*.

Next, as shown in FIG. 9, the second link member 8*c* is pushed down (in a Y2 direction) such that a portion of the seat 8*a* is fitted in the second link member 8*c*. Then, the toggle clamp 8*d* is pushed down, and the end surface 8*b*' of the first link member 8*b* is fixed in the closed position.

In a state shown in FIG. 9, the lateral opening of the press space K is completely closed by the end surface 8*b*' of the first link member 8*b*.

When the upper die 10 is lowered in this state, closed upsetting is performed, and the rare-earth magnet C as a forged product is manufactured. Here, since the end surface 8*b*' of the first link member 8*b* is fixed in the closed position by the toggle clamp 8*d*, the first link member 8*b* is not displaced from a dead point by a forging load that acts thereon during closed upsetting.

After closed upsetting, the toggle clamps 8*d* are released as shown in FIG. 10, and the second link members 8*c* are lifted to open the press space K. Accordingly, the rare-earth magnet C as the forged product that is shaped in the press space K can be taken out. It should be noted that, although each of the toggle clamps 8*d* is also shown in FIG. 10 to separate from the corresponding seat 8*a* for the sake of illustration convenience, the toggle clamp 8*d* is actually fixed to the seat 8*a*.

The embodiments of the invention have been described in detail so far by using the drawings. However, specific configurations are not limited to those in these embodiments, and design changes and the like that fall within the scope of the invention are included in the invention.

What is claimed is:

1. A forming die assembly comprising:

an upper die including a first backup member and a first press member that is attached to the first backup member, wherein the first press member has an L shape in a vertical sectional view and is heat-resistant; and a lower die including a second backup member and a second press member that is attached to the second backup member, wherein the second press member has an L shape in the vertical sectional view and is heat-resistant, wherein the first press member and the second press member press upper and lower surfaces of a workpiece accommodated in a press space that is formed between the first press member and the second press member, so as to produce a forged product, wherein:

one of the upper die and the lower die is provided with a recess and the other of the upper die and the lower die is provided with a projection;

the projection is fitted to the recess when the forming die assembly is in a closed state in which the upper die and the lower die are fitted to each other;

the recess is formed in the corresponding backup member of the one of the upper die and the lower die; and the projection is formed by a portion of the corresponding press member of the other of the upper die and the lower die, and a portion of the corresponding backup member of the other of the upper die and the lower die.

2. The forming die assembly according to claim 1, wherein each of the first press member and the second press member is formed by two plate members.

3. The forming die assembly according to claim 1, wherein each of the first press member and the second press member is formed of ceramic.

4. The forming die assembly according to claim 1, further comprising a closing member that closes a lateral opening of the press space formed between the first press member and the second press member.

5. The forming die assembly according to claim 4, wherein the closing member includes a third backup member and a heat-resistant plate member that contacts the pressed workpiece.

6. The forming die assembly according to claim 5, wherein the heat-resistant plate member is formed of ceramic.

7. The forming die assembly according to claim 4, wherein the closing member includes a link mechanism including a toggle clamp, the link mechanism allows the closing member to be movable between a closed position at which the opening is closed and an open position at which the opening is opened, and the link mechanism is fixed by the toggle clamp when the link mechanism is at the closed position.

* * * * *